US007266213B2

(12) United States Patent
Furuya

(10) Patent No.: US 7,266,213 B2
(45) Date of Patent: Sep. 4, 2007

(54) COMPACT SPEAKER WITH A PROTECTIVE COVER

(75) Inventor: Masahito Furuya, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 10/269,889

(22) Filed: Oct. 15, 2002

(65) Prior Publication Data

US 2003/0081807 A1 May 1, 2003

(30) Foreign Application Priority Data

Oct. 30, 2001 (JP) ..... 2001-333562

(51) Int. Cl.
*H04R 1/02* (2006.01)
*H04R 25/00* (2006.01)

(52) U.S. Cl. ..... 381/398; 381/189

(58) Field of Classification Search ..... 381/396, 381/398, 400, 412, 417, 435
See application file for complete search history.

(56) References Cited

U.S. PATENT DOCUMENTS 3,614,335 A * 10/1971 Dymoke-Bradshaw et al. .. 381/398
4,520,237 A 5/1985 Murakami
6,130,952 A * 10/2000 Akino et al. ..... 381/368
6,661,898 B2 * 12/2003 Kuwabara ..... 381/87
2003/0044040 A1 * 3/2003 Lee et al. ..... 381/396

FOREIGN PATENT DOCUMENTS

| | | |
|---|---|---|
| GB | 1 295790 | 11/1972 |
| JP | 59 140599 | 9/1984 |
| JP | 05 168093 | 7/1993 |
| JP | 10 224879 | 8/1998 |
| JP | 2000 165987 | 6/2000 |
| JP | 2001 036983 | 2/2001 |
| JP | 2002369287 A * | 12/2002 |

* cited by examiner

*Primary Examiner*—Sinh Tran
*Assistant Examiner*—Brian Ensey
(74) *Attorney, Agent, or Firm*—Dennison, Schultz & MacDonald

(57) ABSTRACT

A speaker has a case having a peripheral projection, a magnetic device having a yoke, and a permanent magnet and secured to the case. A diaphragm is secured to the case at the peripheral projection. A protector has an upper plate and a cylindrical holding portion at the periphery of the upper plate. The protector is secured to the case at the cylindrical holding portion.

3 Claims, 3 Drawing Sheets

COMPACT SPEAKER WITH A PROTECTIVE COVER

BACKGROUND OF THE INVENTION

The present invention relates to a speaker used in a portable communication equipment such as a portable telephone and other equipments.

Referring to FIG. 6 showing a conventional speaker, a yoke 2 made of magnetic material is embedded in a case 1 made of plastic by insert molding. A permanent magnet 3 is secured to the yoke 2, and a top plate 4 made of magnetic material is adhered to the magnet 3 to form a magnetic circuit and to form a magnetic gap between the top plate 4 and the yoke 2.

A diaphragm 6 is secured to the case 1 at a shoulder 1*b* of the periphery thereof. A voice coil 5 secured to the underside of the diaphragm 6 is inserted in the magnetic gap. A protector 7 made of metal is secured to the case 1, interposing the diaphragm 6. A plurality of sound discharge holes 7*a* are formed in the protector 7. The diaphragm 6 and the protector 7 are positioned by a cylindrical peripheral projection 1*a*.

A pair of ends 9 of the voice coil 5 are outwardly extended from the case 1 passing through a groove 1*c* formed in a peripheral wall of the case. On the underside of the case 1, a substrate 8 made of plastic is adhered, and a pair of terminal plates 10 are secured to the substrate 8. Each of ends 9 is connected to one of the terminal plate 10 by solder 11. The terminal plate 10 is connected to a circuit of the equipment to be mounted therein.

Thus, when a signal current is applied to the voice coil 5 through the terminal plates 10, the diaphragm 6 vibrates to produce sounds.

In the above described conventional speaker, the diaphragm 6 is positioned by the peripheral projection 1*a* and secured to the shoulder 1*b*. Therefore, the effective diameter dϕ of the diaphragm 6 is reduced by double of width of the peripheral projection 1*a*. The reduction of the diameter of the diaphragm causes the quality of the produced sound to deteriorate.

On the other hand, there are problems in manufacturing of the speaker. In the manufacturing, after the diaphragm 6 and the protector 7 are secured to the shoulder 1*b* the case 1 is inverted in order to solder the ends 9 to terminal plates 10. However, the inverting operation of the case causes the manufacturing operation of the speaker to complicate.

SUMMARY OF THE INVENTION

An object of the present invention is to provide a speaker which may obviate the above described troubles.

According to the present invention is to provide a speaker comprising a case having a peripheral projection, a magnetic device having a yoke, and a permanent magnet and secured to the case, a diaphragm secured to the case at the peripheral projection, a voice coil secured to an underside of the diaphragm, and a protector having an upper plate and a cylindrical holding portion at a periphery of the upper plate and secured to the case at the cylindrical holding portion.

The speaker according to claim 1 wherein the cylindrical holding portion of the protector has an axial length so as to overlap with the peripheral projection of the case in order to secure the protector to the case.

The speaker according to claim 1 further comprising a hold ring provided in the protector for securing the diaphragm to the case.

The speaker according to claim 1 wherein the protector has a stepped hold portion between the upper plate and the cylindrical holding portion, and the diaphragm is secured to the case by the stepped hold portion.

A method for manufacturing a speaker comprising steps of providing an assembly of a case having a peripheral projection and terminals on an underside, thereof and a magnetic device having a yoke, and a permanent magnet, providing a diaphragm having a voice coil secured to an underside of the diaphragm, providing a protector having an upper plate and a cylindrical holding portion at a periphery of the upper plate, mounting the protector on a base in an inverted position, inserting the voice coil in the protector in an inverted position, pulling out a pair of ends of the voice coil, inserting the assembly in the protector in an inverted position, securing the cylindrical holding portion of the protector to the peripheral projection of the case, and connecting the ends of the voice coil to the terminals on the case.

These and other objects and features of the present invention will become more apparent from the following detailed description with reference to the accompanying drawings.

DETAILED DESCRIPTION OF THE PREFERRED EMBODIMENT

Figure 1:
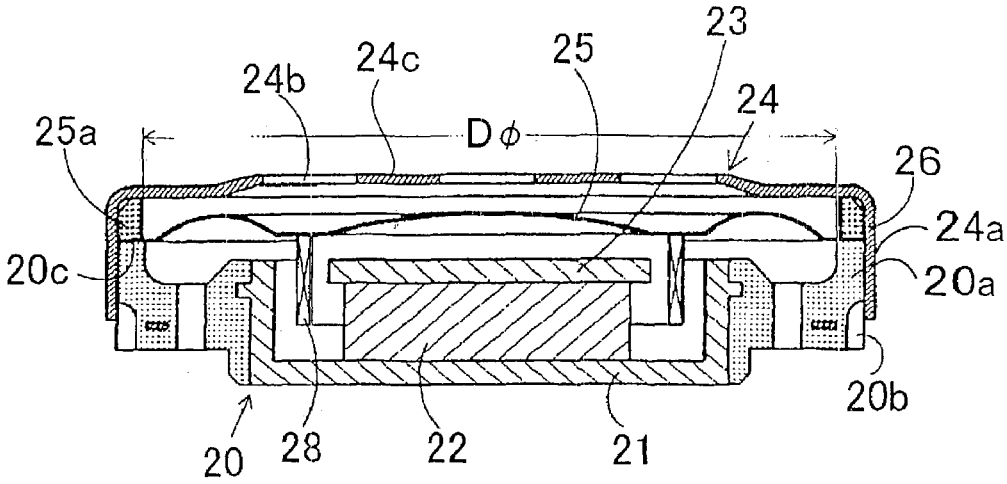
FIG. 1 is a sectional view showing a speaker according to a first embodiment of the present invention.

Referring to FIG. 1, a case 20 made of plastic has cylindrical peripheral projection 20*a* having a flat top surface. The speaker comprises a yoke 21 made of magnetic material and embedded in the case 20 by insert molding, a permanent magnet 22 secured to the yoke 21, and a top plate 23 adhered to the magnet 22.

A protector 24 comprises an upper plate 24*c* and a cylindrical holding portion 24*a* downwardly extending from the periphery of the upper plate 24*c*. A diaphragm 25 is held between a hold ring 26 provided in the protector 24 and the peripheral projection 20*a* of the case 20 at a peripheral portion 25*a*. The holding portion 24*a* of protector 24 has a length overlapping with the projection 20*a* of the case 20 and is secured to the case 20 by an adhesive set in an annular groove 20*b* formed in the peripheral wall of the case. A voice coil 28 secured to the underside of the diaphragm 25 is inserted in the magnetic gap between the top plate 23 and the yoke 21. A plurality of sound discharge holes 24*b* are formed in the protector 24. A pair of ends 30(FIG. 4) of the voice coil 28 are adhered to the underside of the diaphragm 25.

Figure 2:
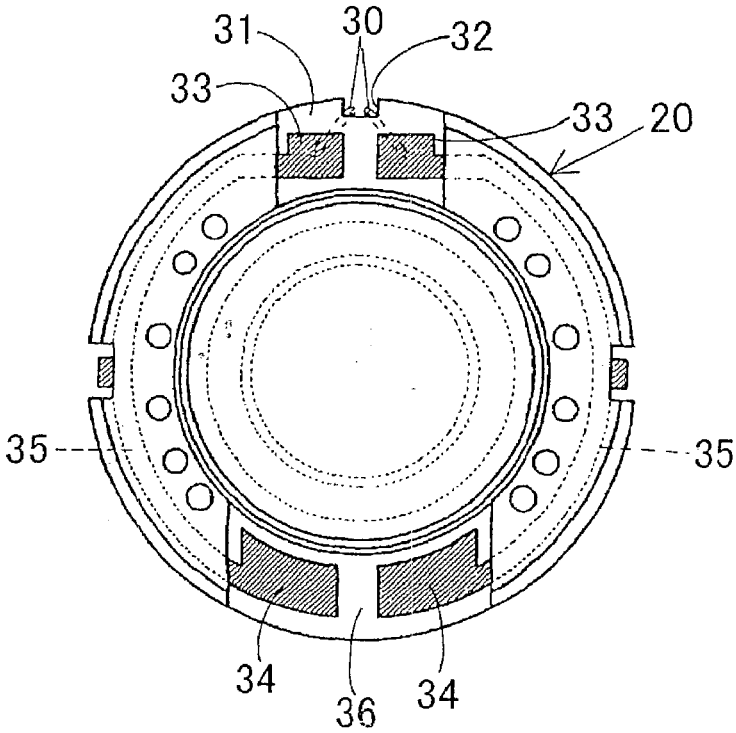
FIG. 2 is a plan view showing the underside of the speaker.
Figure 3:
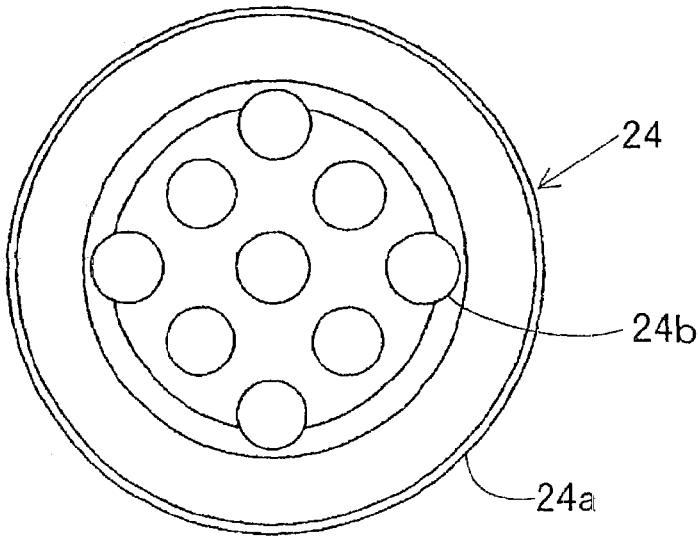
FIG. 3 is a plan view showing the underside of a protector.

Referring to FIG. 2, the ends 30 are introduced in a recess 31 formed in the underside of the case 20, passing through a guide groove 32 of the peripheral wall of the case. Each end 30 is connected to an end plate 33 adhered on the underside of the case. The end plate 33 is connected to a terminal plate 34 in a recess 36 at the opposite side by a lead 35 embedded in the case. The terminal plate 34 is contacted with a terminal of an equipment in which the speaker is mounted.

The diaphragm 25 is accurately centered by the engagement of the periphery thereof with the inside wall of the protector 24. Since the top 20*c* of the peripheral projection 20*a* of the case 20 is flat without shoulder, the width of the top surface can be largely reduced, and the effective diameter Dϕ of the diaphragm 25 can be increased compared with the width of the conventional peripheral projection. Thus, it is possible to provide a speaker producing a high-quality sound.

Figure 4:
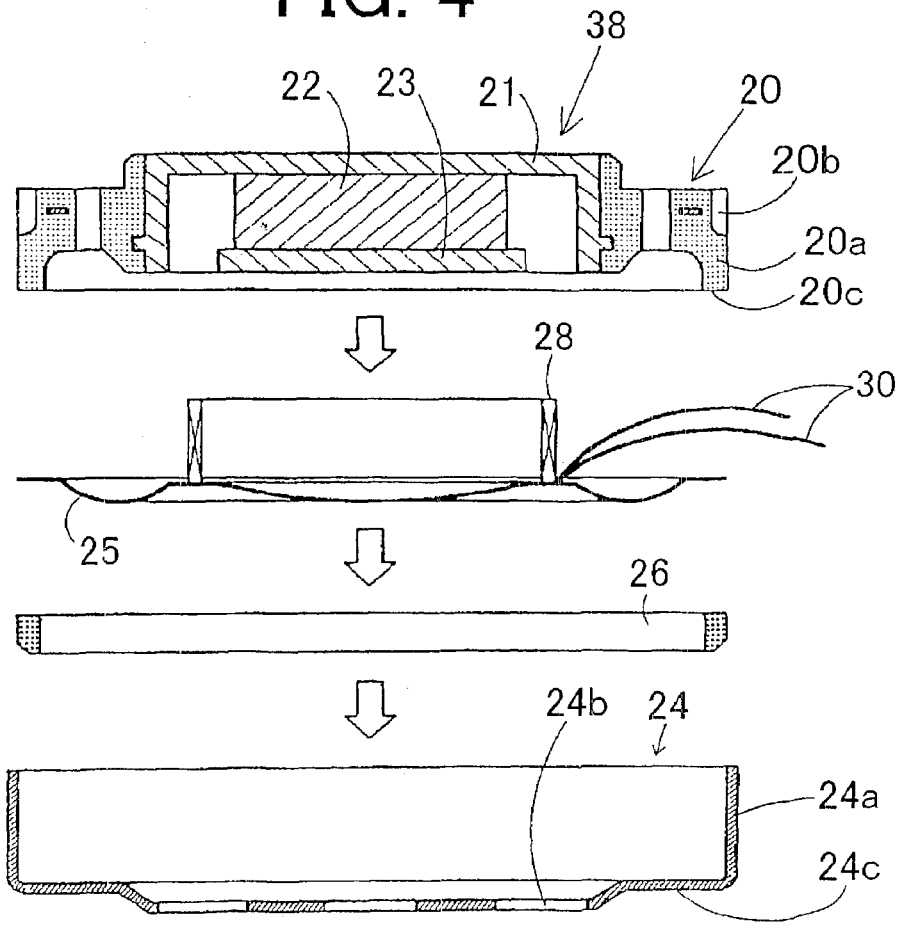
FIG. 4 is an exploded sectional view for explaining manufacturing process of the speaker.

The method for manufacturing the speaker of the first embodiment of the present invention is described hereinafter with reference to FIG. 4.

The protector 24 is mounted on a base (not shown) in an inverted position, and the hold ring 26 is inserted in protector 24 and disposed on the bottom corner 24*c*. Then, the diaphragm 25 having the voice coil 28 is inserted in the protector, and a preliminarily assembled magnetic device and case assembly 38 is inserted in the protector 24 in the inverted position by the guiding of the holding portion 24*a* of the protector 24. Thereafter, an adhesive is poured in the annular groove 20*b* of the case, under the condition that the magnetic device and case assembly 38 are pressed against the hold ring 26. The ends 30 of the voice coil 28 are connected to the end plates 33 (FIG. 2). Thus, the speaker is completed without inverting the parts during the manufacturing process.

Figure 5:
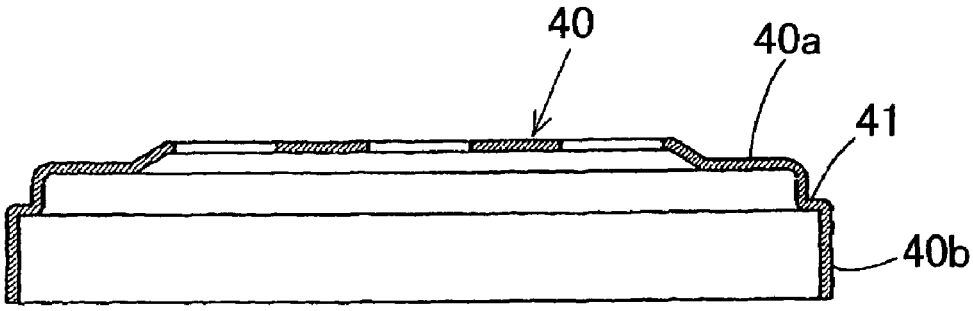
FIG. 5 is a sectional view showing a protector according to a second embodiment of the present invention.
Figure 6:
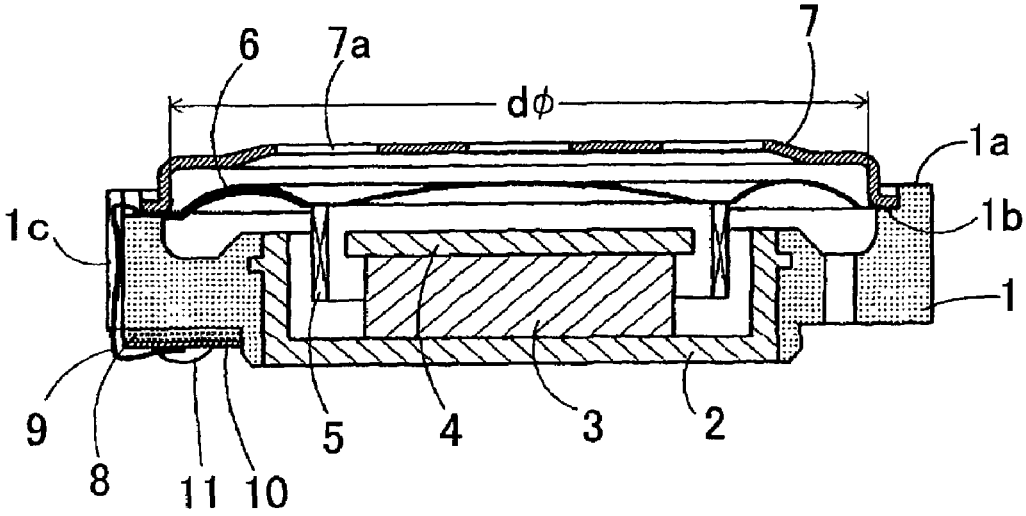
FIG. 6 PRIOR ART
FIG. 6 is a sectional view of a conventional speaker.

Referring to FIG. 5 showing a protector in the second embodiment, the protector 40 has a stepped hold portion 41 between a top plate 40*a* and a cylindrical holding portion 40*b*. The peripheral portion of the diaphragm 25 is caught by the stepped hold portion 41 and the projection 20*a* of the case 20. Thus, the hold ring 26 in the first embodiment is omitted, thereby reducing the number of parts of the speaker.

In accordance with the present invention, the effective area of the diaphragm can be increased compared with the conventional speaker. Furthermore, the speaker can be manufactured in simple steps.

While the invention has been described in conjunction with preferred specific embodiment thereof, it will be understood that this description is intended to illustrate and not limit the scope of the invention, which is defined by the following claims.

What is claimed is:

1. A speaker comprising:

a case having a cylindrical peripheral projection, the projection having a uniform continuous outside wall and a top flat surface and an inside wall downwardly extending from an inside edge of the top flat surface to form an inside cylindrical acoustic space;

a magnetic device having a yoke embedded in the case, and a permanent magnet secured to the yoke;

a diaphragm having a peripheral portion, and disposed on the top flat surface of the cylindrical peripheral projection of the case at the peripheral portion thereof;

a voice coil secured to an underside of the diaphragm;

a hold ring mounted on the periphery of the diaphragm on the top flat surface of the case for securing the diaphragm to the case;

a protector having an upper plate and a cylindrical holding portion downwardly extending from a periphery of the upper plate, and having a continuous inside surface at the cylindrical holding portion;

the protector being disposed to press the hold ring to the diaphragm, and the continuous inside surface of the cylindrical holding portion of the protector being secured to the uniform continuous outside wall of the case.

2. The speaker according to claim 1 wherein the cylindrical holding portion of the protector has a length in an axial direction of the speaker so as to overlap with the peripheral projection of the case.

3. A speaker comprising:

a case having a cylindrical peripheral projection, the projection having a uniform continuous outside wall and a top flat surface and an inside wall downwardly extending from an inside edge of the top flat surface to form an inside cylindrical acoustic space;

a magnetic device having a yoke embedded in the case, and a permanent magnet secured to the yoke;

a diaphragm having a peripheral portion, and disposed on the top flat surface of the cylindrical peripheral projection of the case at the peripheral portion thereof;

a voice coil secured to an underside of the diaphragm;

a protector having an upper plate, a cylindrical holding portion downwardly extending from a periphery of the upper plate, and a stepped hold portion provided between the upper plate and the cylindrical holding portion, the cylindrical holding portion having a continuous inside surface;

the protector holding the diaphragm between the stepped hold portion and the top flat surface of the peripheral projection of the case, and the continuous inside surface of the cylindrical holding portion of the protector being secured to the uniform continuous outside wall of the case.

* * * * *